US008534375B2

(12) United States Patent
Matsumoto et al.

(10) Patent No.: US 8,534,375 B2
(45) Date of Patent: Sep. 17, 2013

(54) ELECTRIC POWER TOOL WITH A HOLDING DEVICE

(75) Inventors: Hiroshi Matsumoto, Hikone (JP); Masamichi Nakamura, Hikone (JP); Hidekazu Yuasa, Hikone (JP)

(73) Assignee: Panasonic Corporation, Osaka (JP)

( * ) Notice: Subject to any disclaimer, the term of this patent is extended or adjusted under 35 U.S.C. 154(b) by 336 days.

(21) Appl. No.: 12/889,528

(22) Filed: Sep. 24, 2010

(65) Prior Publication Data

US 2011/0073340 A1 Mar. 31, 2011

(30) Foreign Application Priority Data

Sep. 25, 2009 (JP) ..... 2009-221516

(51) Int. Cl.
*B25F 5/02* (2006.01)

(52) U.S. Cl.
USPC ..... 173/171; 173/170; 16/426; 16/110.1; 224/197; 224/251; 224/269; 224/904

(58) Field of Classification Search
USPC ..... 173/170, 171; 16/426, 110.1; 224/197, 224/252, 269, 904, 251
See application file for complete search history.

(56) References Cited

U.S. PATENT DOCUMENTS

| | | | | |
|---|---|---|---|---|
| 5,265,312 | A | 11/1993 | Okumura | |
| 6,321,622 | B1 | 11/2001 | Tsuge et al. | |
| 6,591,646 | B1 * | 7/2003 | Huang | 70/456 R |
| 6,688,407 | B2 * | 2/2004 | Etter et al. | 173/170 |
| 6,905,052 | B2 * | 6/2005 | Sakai et al. | 224/269 |
| 7,108,079 | B2 | 9/2006 | Sakai et al. | |
| 7,308,290 | B2 * | 12/2007 | Johnson et al. | 455/575.1 |
| 7,492,125 | B2 * | 2/2009 | Serdynski et al. | 320/114 |
| 8,167,056 | B2 * | 5/2012 | Ito et al. | 173/171 |
| 2003/0066666 | A1 | 4/2003 | Etter et al. | |
| 2005/0015935 | A1 * | 1/2005 | Bader et al. | 16/430 |
| 2009/0134191 | A1 * | 5/2009 | Phillips | 224/269 |

FOREIGN PATENT DOCUMENTS

| | | |
|---|---|---|
| DE | 42 33 239 | 4/1993 |
| DE | 199 46 455 | 4/2000 |
| EP | 1 033 207 | 9/2000 |
| EP | 2 022 607 | 2/2009 |
| JP | 62-103643 | 7/1987 |
| JP | 2004-255503 | 9/2004 |
| JP | 2005-313322 | 11/2005 |
| JP | 3134808 | 8/2007 |
| WO | 2007/118296 | 10/2007 |

OTHER PUBLICATIONS

The extended European search report dated Jan. 21, 2011.
Office Action dated May 21, 2013 issued in the corresponding Japanese application No. 2009-221516 (w/English summary thereof).

* cited by examiner

*Primary Examiner* — Michelle Lopez
(74) *Attorney, Agent, or Firm* — Bacon & Thomas, PLLC

(57) ABSTRACT

An electric power tool includes a body part for outputting a rotational force at one end thereof, a grip part provided to extend from the body part in an intersecting relationship with the body part, and a suspension link provided at the other end of the body part for hanging the body part. The suspension link is configured to ensure that, if the body part is suspended from the suspension link using the suspension link as a pivot point, the electric power tool is kept by a weight balance in a horizontal posture in which the extension direction of the grip part is substantially orthogonal to the vertical direction or an inclined horizontal posture in which the joint portion of the body part and the grip part is positioned at the upper side.

10 Claims, 8 Drawing Sheets

ELECTRIC POWER TOOL WITH A HOLDING DEVICE

FIELD OF THE INVENTION

The present invention relates to an electric power tool and, more particularly, to a holder unit for holding an electric power tool during transportation.

BACKGROUND OF THE INVENTION

Conventionally, a portable electric power tool such as an electric drill or an impact driver is held by a user's belt using a locking member such as a hook or the like fastened to the belt as disclosed in Japanese Patent Application Publication Nos. 2004-255503 and 2005-313322, in which state the user moves to a job site or conducts preparations for works, e.g., a task of mounting a workpiece to which a rotational drive force is outputted.

For example, Japanese Patent Application Publication No. 2004-255503 discloses an electric power tool including a grip part, a drive part (body part) respectively provided at the upper side of the grip part and a base part having a battery chamber (battery). A leg portion of a hook for use with a belt is attached to the side wall of the base part. The hook is inserted between the belt and the waist so that the belt can be positioned between the hook and the base part. Thus, the electric power tool is held by the belt in a posture inverted to the in-use posture, namely in such a posture that the axis of the grip part extends in a vertical direction with the front end of the drive part facing toward the user's back.

Japanese Patent Application Publication No. 2005-313322 discloses an electric power tool including a body part for accommodating a motor and a handle part (grip part) suspended from the body part. A hook-shaped locking member is removably attached to the side surface of a lower end portion of the handle part. The electric power tool is held by a belt in such a way that the locking member is inserted and interposed between the belt and the waist. In particular, the locking member is rotatable with respect to the side surface of the lower end portion of the handle part. This makes it possible to change the posture of the electric power tool held by the belt. By allowing the grip part to extend horizontally along the belt, it is possible to hold the electric power tool in a posture in which there is no need to twist the wrist of the hand holding the grip part.

With the electric power tool held by the belt in an inverted posture as disclosed in Japanese Patent Application Publication No. 2004-255503, there is a need to heavily twist the wrist of the hand gripping the grip part when detaching the tool from the belt. This imparts a heavy burden on the wrist during detachment of the tool, thereby making it inconvenient to use the tool. In case of the electric power tool whose posture can be changed in the belt-held state as disclosed in Japanese Patent Application Publication No. 2005-313322, the wrist bears a reduced burden. However, if the user has a corpulent body, the abdominal fat leaves no gap between the grip part and the belt, which makes it impossible to insert the thumb between the grip part and the belt. In addition, the upper portions of the locking member and the belt are hidden under the abdomen, which makes it difficult to remove the locking member from the belt. Moreover, if the thumb is inserted by force or if the tool is forcibly removed from the belt, the locking member may be separated from the tool or may be deformed. This may be a cause of failure or breakage.

In other words, since the locking member is directly fastened to the belt in the conventional electric power tools, the abdomen may become an obstacle depending on the body type of a user. This poses a problem in that it becomes difficult to attach and detach the electric power tool. Furthermore, since the electric power tool is virtually fixed to the belt in the belt-held state, the tool may make contact with the user's leg and may sometimes drop from the belt. This may restrain movement of the user who performs work preparations with the electric power tool held by the belt.

Additionally, since the locking member is arranged below the grip part, it is hidden under the hand or the arm gripping the grip part when fastening the locking member to the belt. Thus, the user cannot know where the tip end portion of the locking member exists. This poses a problem in that it is difficult to attach the locking member to the belt.

SUMMARY OF THE INVENTION

In view of the above, the present invention provides an electric power tool capable of reducing the burden borne by the gripping hand when attaching or detaching the electric power tool, capable of eliminating the restraints imposed on the movement of a user who performs work preparations and capable of enhancing the ease of use.

In accordance with an embodiment of the present invention, there is provide an electric power tool, including: a body part for outputting a rotational force at one end thereof; a grip part provided to extend from the body part in an intersecting relationship with the body part; and a suspension link provided at the other end of the body part for hanging the body part, wherein the suspension link is configured to ensure that, if the body part is suspended from the suspension link using the suspension link as a pivot point, the electric power tool is kept by a weight balance in a horizontal posture in which the extension direction of the grip part is substantially orthogonal to the vertical direction or an inclined horizontal posture in which the joint portion of the body part and the grip part is positioned at the upper side.

With such configuration, it is possible to hold the electric power tool in position with the suspension link when not in use. The user can grip the grip part of the electric power tool hung on by the suspension link with little need to twist the wrist. Further, the grip part is kept by a weight balance in a horizontal posture or an inclined horizontal posture. This enables a user to hang the electric power tool on a hanger such as a hook or a lug without having to worry about the posture of the tool. Thanks to this feature, the user can easily attach the tool to the hanger without having to twist the wrist of the hand gripping the grip part during the hanging operation. Since the grip part of the suspended electric power tool is kept substantially in a horizontal posture or an inclined horizontal posture, the user can grip the grip part and remove the electric power tool from the hanger with little twist of the wrist. Thus, the electric power tool is capable of reducing the burden borne by the user when the tool is hung on with the suspension link, enabling the user to easily attach and remove the tool during the hanging operation and enhancing the ease of use.

In the electric power tool, the suspension link may include a through-hole orthogonal to both the extension direction of the grip part and the vertical hanging direction of the body part.

With such configuration, the electric power tool can be suspended to extend along the side surface of the user's body or the wall surface of the structure having the hanger by merely hanging the suspension link on the hanger. This makes it possible to reduce the amount of protrusion of the grip part from the side surface of the user's body or the wall surface, thereby preventing the suspended electric power tool from hindering the work preparations.

In the electric power tool, the suspension link may be made of a rigid material.

With such configuration, the suspension link is not readily deformed. Thus, the user can hang the suspension link on the hanger without having to keep the shape of the suspension link with the hand during the hanging operation, which makes it possible to suspend the electric power tool with ease.

In the electric power tool, the body part may include an accommodation portion for accommodating the suspension link, the suspension link being position-changeable between a folded position in which the suspension link is accommodated within the accommodation portion and a hanging position in which the body part is suspended from the suspension link.

With such configuration, it is possible for the accommodation portion to accommodate the suspension link when there is no need to perform a hanging operation. Thus, the suspension link does not become an obstacle when the electric power tool is in use. This makes it possible to further enhance the ease of use of the electric power tool.

In the electric power tool, the suspension link may be made of a rigid material and be position-changeable between a folded position in which the suspension link is accommodated within an accommodation portion and a hanging position in which the body part is suspended from the suspension link, the body part including a movement restraint portion for restraining the position-changing movement of the suspension link in the hanging position.

With such configuration, it is possible to prevent the suspension link from moving out of the hanging position when suspending the electric power tool. Since there is no need for the user to keep the shape of the suspension link when the latter is hung on the hanger, it is possible for the user to easily suspend the electric power tool with the suspension link.

In the electric power tool, the accommodation portion may be designed to accommodate the suspension link in a state that the suspension link partially protrudes from the body part, the partially protruding portion of the suspension link serving as a finger engagement portion for a user to take out the suspension link from the accommodation portion.

With such configuration, it is possible to easily unfold the suspension link from the accommodation portion and to easily perform the task of changing the position of the suspension link to the hanging position. This assists in further enhancing the ease of use.

In the electric power tool, the body part may include two through-holes extending through the body part, the suspension link having a continuous loop shape and passing through the through-holes of the body part.

In the electric power tool, the body part may include two through-holes extending through the body part, the suspension link having a continuous loop shape and passing through the through-holes of the body part, and further including an elastic member arranged within the body part for elastically holding the suspension link, the elastic member being designed to make contact with the portion of the suspension link passing through the through-holes of the body part.

With such configuration, there is no possibility that the shaft is removed from the body part. Therefore, it is possible to prevent the suspension link from being separated from the body part by the own weight of the suspended electric power tool or by the shock generated when the tool is dropped. This assists in enhancing the safety. Since the suspension link is elastically held in the folded position or the hanging position by the elastic member built in the body part, it is possible to easily keep the suspension link in the folded position or the hanging position. This assists in further enhancing the ease of use.

BRIEF DESCRIPTION OF THE DRAWINGS

The objects and features of the present invention will become apparent from the following description of embodiments, given in conjunction with the accompanying drawings, in which.

DETAILED DESCRIPTION OF THE PREFERRED EMBODIMENTS

One embodiment of an electric power tool in accordance with the present invention will now be described with reference to the accompanying drawings which form a part hereof.

Figure 1A:
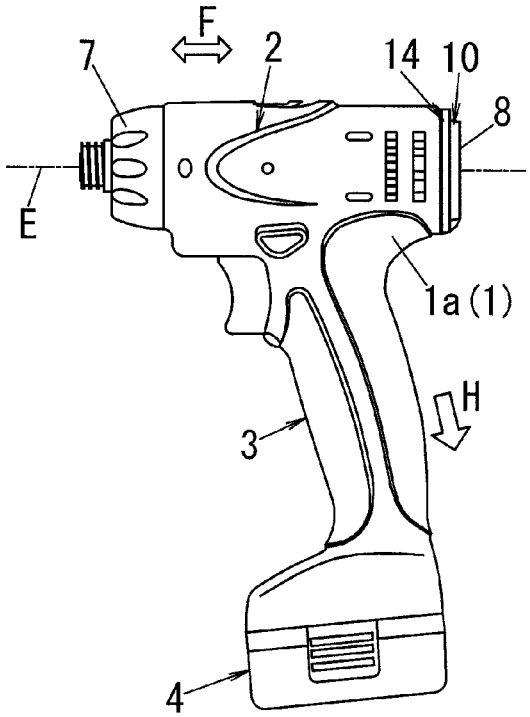
FIG. 1A is a left side view showing an electric power tool in accordance with the present invention, in which view a suspension link is in a folded state.
Figure 1B:
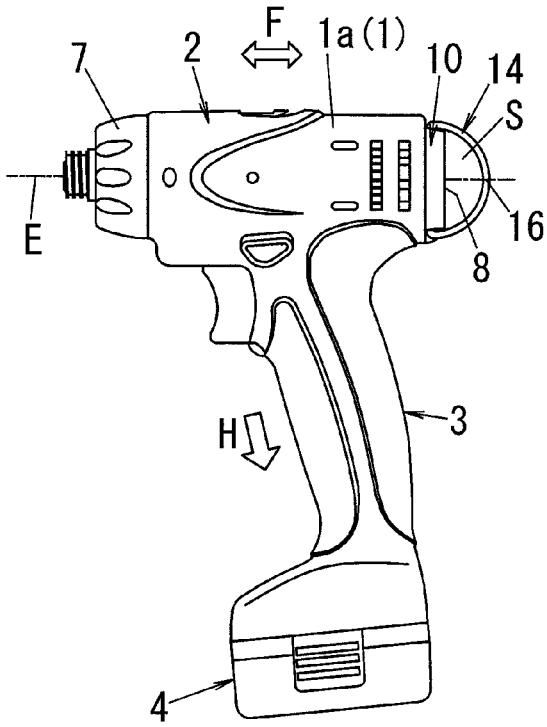
FIG. 1B is a left side view of the electric power tool with the suspension link unfolded and FIG. 1C is a right side view of the electric power tool with the suspension link unfolded.
Figure 1C:
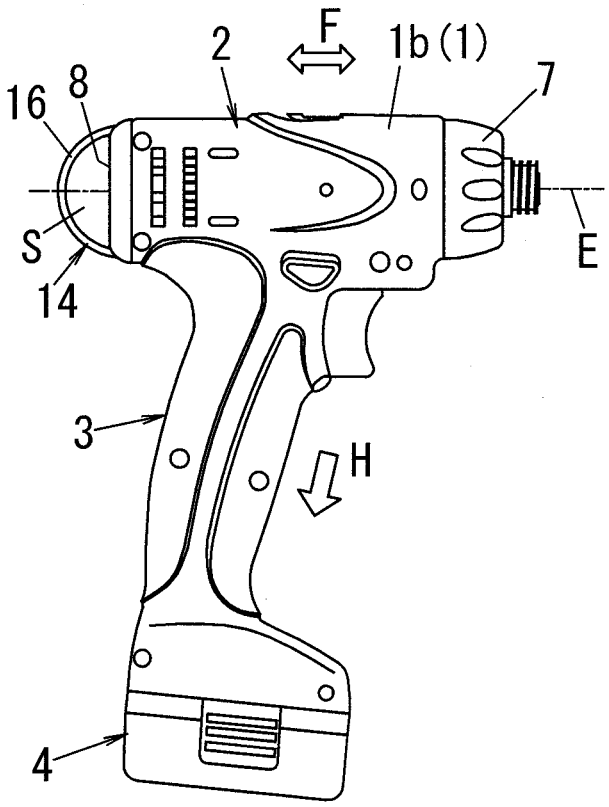

Referring to FIG. 1, an electric power tool in accordance with the present invention includes a tubular body part 2 for outputting rotational drive power at one end thereof, a grip part 3 provided to extend from the body part 2 in an intersecting relationship with the axis of the body part 2 and a battery part 4 detachably attached to tip end of the grip part 3 in the extension direction H. A housing 1, which forms the shells of the body part 2 and the grip part 3, is divided into two parts through the central axis of the body part 2 along the extension direction H of the grip part 3.

In the following description, the left half of the housing 1 having the left shell of the body part 2 and the grip part 3 will be referred to as "left housing 1*a*" and the right half thereof as "right housing 1*b*", thereby distinguishing the divided parts of the housing 1 from each other. The direction running along the central axis of the body part 2 will be referred to as "axial direction F", and the straight line substantially coinciding with the central axis will be referred to as "axial line E".

A drive power source 6 such as a motor or the like and a speed changing unit (not shown) for changing the rotation speed of the drive power source 6 are arranged within the body part 2. At one end of the body part 2 in the axial direction F, there is provided an output unit 7 for outputting the rotational drive power subjected to speed change in the speed changing unit. The output unit 7 includes a chuck for holding a tip tool. Using to the tip tool, the electric power tool performs a task of tightening a fastener such as a screw or a nut or a task of forming a hole.

Figure 2A:
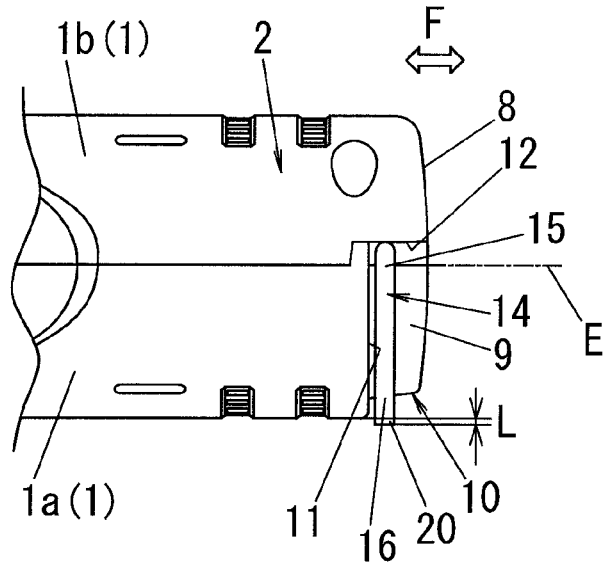
FIG. 2A is a plan view showing the suspension link kept in a folded state and its surrounding structures.
Figure 2B:
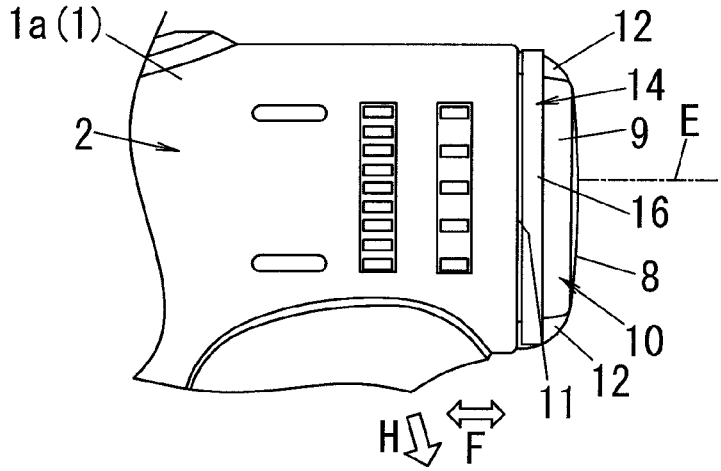
FIG. 2B is a left side view thereof and FIG. 2C is a right side view thereof with a right housing part removed.
Figure 2C:
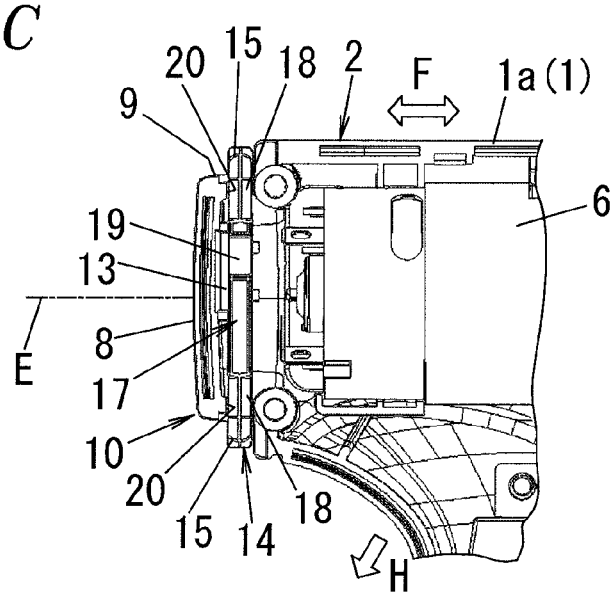
Figure 3A:
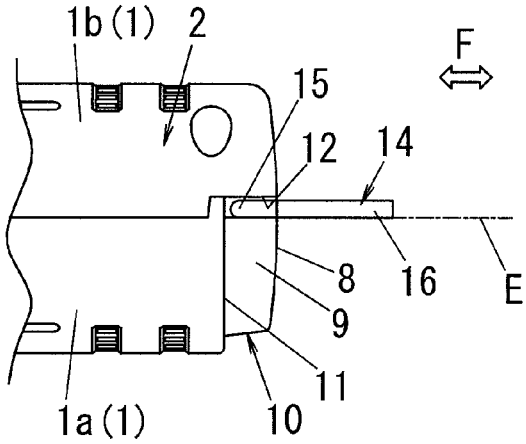
FIG. 3A is a plan view showing the suspension link kept in an unfolded state and its surrounding structures.
Figure 3B:
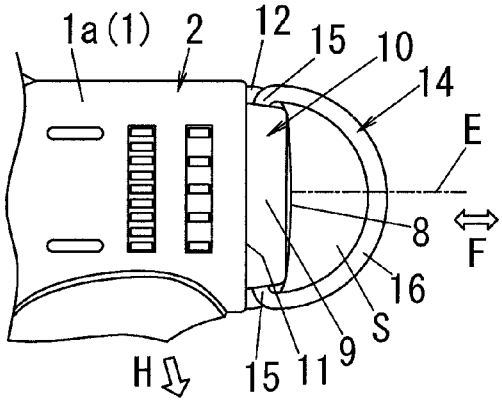
FIG. 3B is a left side view thereof and FIG. 3C is a right side view thereof with the right housing part removed.
Figure 3C:
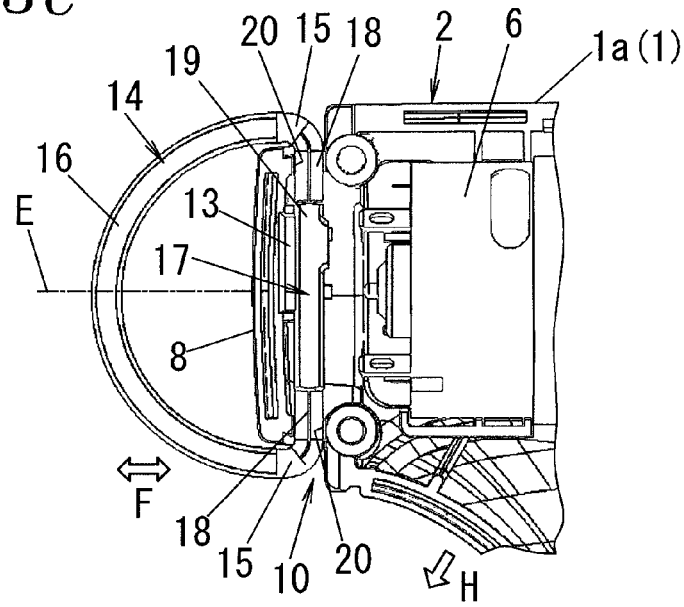
Figure 4A:
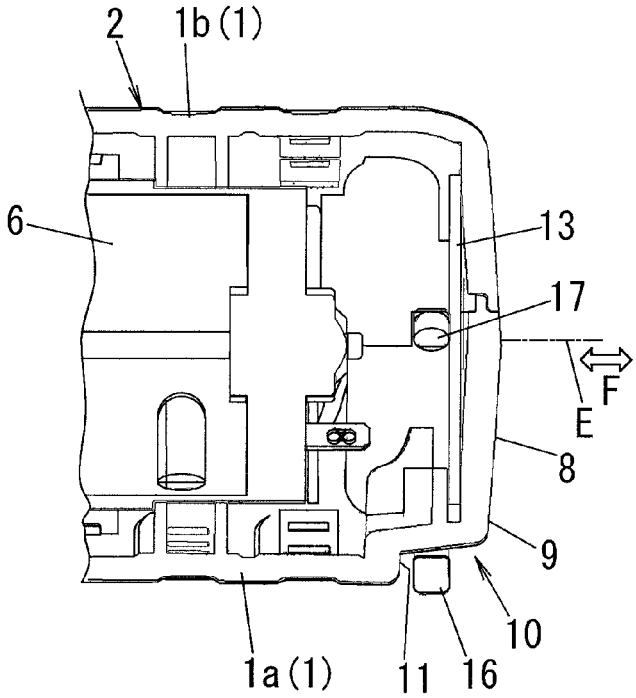
FIG. 4A is a view for explaining the rotating movement of the suspension link, in which view the suspension link is in a folded position.
Figure 4B:
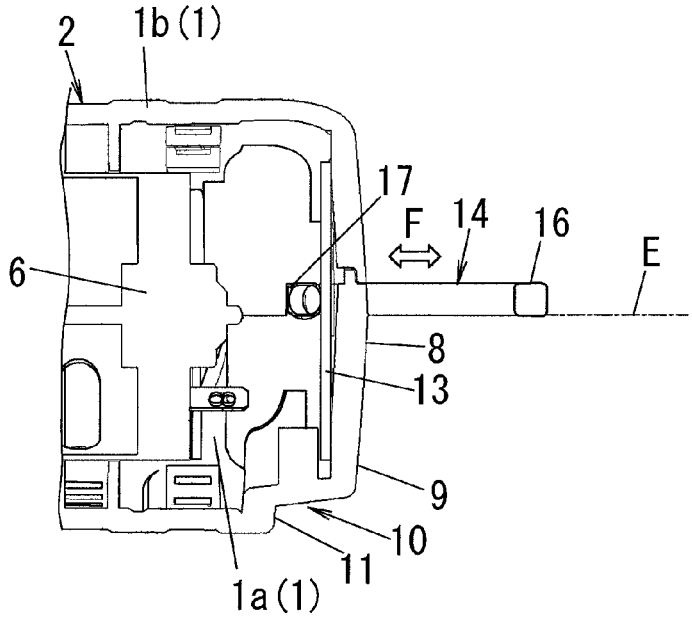
FIG. 4B is a view showing the suspension link kept in an unfolded position and FIG. 4C is a view showing the suspension link under a position-changing process.
Figure 4C:
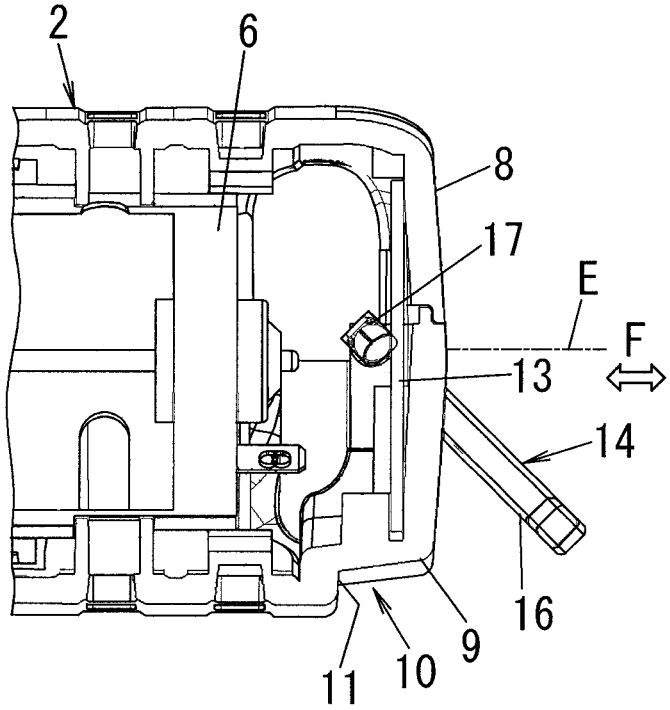

As shown in FIGS. 2 through 4, the other end of the body part 2 includes a substantially circular end surface 8 formed of two concentrically-mated semicircular portions differing in diameter. The large-diameter portion of the end surface 8 has substantially the same diameter as that of the body part 2 and is formed in the right housing 1*b*. The small-diameter portion has a diameter smaller than that of the body part 2 and is formed in the left housing 1*a*. As a result, the other end of the body part 2 includes an arc-shaped recess 10 radially inwardly depressed over one half of the perimeter of the body part 2. A suspension link 14 serving as a pivot point when the electric power tool is hung on is rotatably arranged in the recess 10.

More specifically, the left housing 1*a* includes a small-diameter portion 9 formed in the other end of the body part 2 and having an outer diameter smaller than that of the remaining portion of the body part 2. The level difference, which is generated by the difference in outer diameter between the small-diameter portion 9 and the remaining portion of the body part 2, makes up the recess 10. Thus, the planar surface between the small-diameter portion 9 and the remaining portion of the body part 2 makes up a fan-shaped bottom portion 11 of the recess 10. The outer circumferential surface of the small-diameter portion 9 makes up the curved inner wall of the recess 10. Cutouts opened outwards are formed at the opposite ends of the arc of the inner wall.

The opposite ends of the arc of the inner wall are positioned in the seam portions of the left housing 1*a*. The right housing 1*b* includes end walls 12 lying at opposite ends of the arc of the inner wall, each of the end walls 12 having surfaces extending in the extension direction H. As the left housing 1*a* and the right housing 1*b* are combined together, the openings of the cutouts are closed by the end walls 12. Thus, the cutouts make up pivot holes extending through the body part 2 in an orthogonal relationship with the axial line E and running rectilinearly along the extension direction H. The suspension link 14 includes a shaft 17 inserted into the pivot holes. The shaft 17 serves as a central axis about which the suspension link 14 rotates.

The shaft 17 has a rod-like shape and includes a prism portion 19 of substantially square shape in cross section with side surfaces perpendicular to one another and a pair of cylinder portions 18 positioned at the opposite ends of the prism portion 19 and provided with an outer circumferential surface making sliding contact with the pivot holes of the housing 1. One of the side surfaces of the prism portion 19 comes into contact with the flat surface of an elastic member, e.g., a leaf spring 13, arranged inside of the body part 2 and is pressed toward the one end of the body part 2, thereby restraining rotation of the shaft 17.

More specifically, the leaf spring 13 includes a flat surface extending in the direction orthogonal to both the axial direction F and the central axis of the shaft 17. One longitudinal end of the flat surface is fixed to the inner surface of the left housing 1*a* within the body part 2. One of the side surfaces of the prism portion 19 remains in contact with the flat surface of the leaf spring 13. If the shaft 17 is rotated against the pressing force of the leaf spring 13, the next side surface of the prism portion 19 makes contact with the flat surface of the leaf spring 13, consequently stopping rotation of the shaft 17.

In other words, each of the side surfaces of the prism portion 19 makes contact with the leaf spring 13 each time when the shaft 17 is rotated by about 90 degrees. This enables a user to have a clicking sense as the shaft 17 rotates about 90 degrees into the respective positions where the shaft 17 is resiliently held by the leaf spring 13. Thanks to this feature, the position of the suspension link is determined every 90 degrees by the leaf spring 13 during its rotation. In the respective positions where each of the side surfaces of the prism portion 19 makes contact the flat surface of the leaf spring 13, the rotation of the suspension link 14 is restrained by the pressing force of the leaf spring 13.

The opposite ends of the shaft 17 are connected to an arc portion 16 through curved portions 15, the arc portion 16 formed into an arc shape about the intersection point of the shaft 17 and the axial line E. The suspension link 14 makes up a "D"-shaped ring in which the space S (see FIG. 1) inside the arc portion 16 serves as a through-hole. In other words, due to the presence of the curved portions 15, the suspension link 14 has a continuous loop shape with no disconnection existing in the end portions of the arc portion 16 or the shaft 17. Thus, the arc portion 16 is held in the body part 2 by the shaft 17. This eliminates the possibility that the shaft 17 is removed from the body part 2 and the suspension link 14 is separated from the body part 2.

By rotating the arc portion 16 approximately 90 degrees about the shaft 17, the arc portion 16 can be switched between a folded position in which the arc portion 16 is folded into the recess 10 and an unfolded position in which the fan-shaped side surface of the arc portion 16 is partially in contact with the end walls 12 of the recess 10. In the unfolded position, the substantially central point of the arc of the arc portion 16 overlaps with the axial line E. The middle extension of the arc portion 16 of the suspension link 14 protrudes farthest from the other end of the body part 2 in the axial direction F. The through-hole of the suspension link 14 is orthogonal to the axial direction F and the extension direction H.

In other words, the shaft 17 and the arc portion 16 are coplanar with the axial direction F in the unfolded position. Even if a force is applied to the arc portion 16 in the axial direction F or the extension direction H when the arc portion 16 is in the unfolded position, there is no possibility that the arc portion 16 is rotated about the shaft 17. The unfolded position is a hanging position in which the electric power tool can be hung on by the suspension link 14.

Figure 5A:
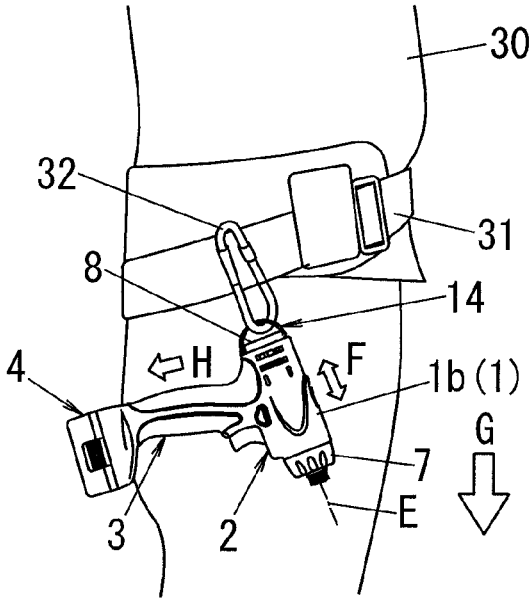
FIG. 5A is a right side view for explaining the hanging posture of the electric power tool, in which view the tool is in a horizontal posture.
Figure 5B:
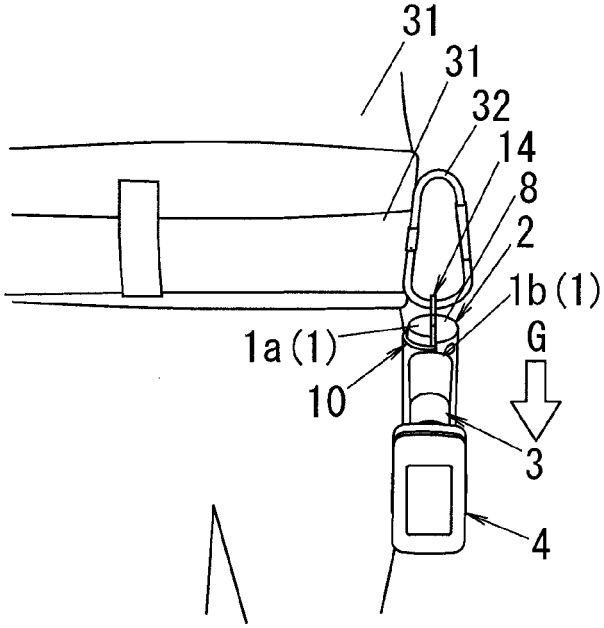
FIG. 5B is a rear view of the electric power tool, in which view the tool is in the horizontal posture.
Figure 5C:
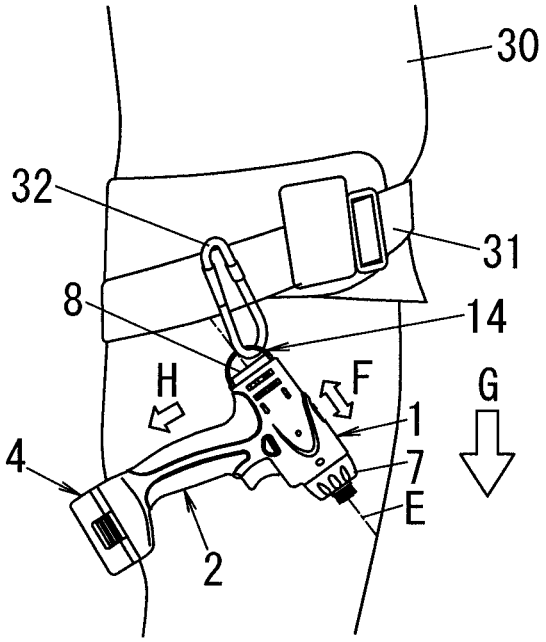
FIG. 5C is a right side view of the electric power tool, in which view the tool is in an inclined horizontal posture.

In the hanging position, as illustrated in FIG. 5, a belt 31 of a user 30 or a hanger 32 such as a carabiner, a hook or a lug is inserted through the "D"-shaped internal space S of the suspension link 14 and is bought into contact with the inner circumferential surface of the arc portion 16. Thus, the suspension link 14 is hung on the hanger 32, as a result of which the electric power tool can be suspended from the hanger 32. The contact point between the hanger 32 and the suspension link 14 becomes the pivot point of the electric power tool. Due to the weight balance between the body part 2 and the battery part 4, the suspended electric power tool is kept in a horizontal posture in which the extension direction H of the grip part 3 is substantially orthogonal to the vertical direction G or an inclined horizontal posture in which the joint portion of the body part 2 and the grip part 3 is positioned at the upper side in the vertical direction G.

If the extension direction H of the grip part 3 is kept horizontal or obliquely horizontal with respect to the vertical direction G, the possibility of the battery part 4 being positioned higher than the hanger 32 or the grip part 3 is eliminated by the own weight of the electric power tool and the weight balance between the body part 2 and the battery part 4. Thus, the electric power tool takes a posture in which the axial line E is not orthogonal to the vertical direction G.

In other words, if the suspension link 14 is just hung on the hanger 32 through the through-hole thereof regardless of the orientation or inclination of the grip part 3 so that the inner circumferential surface of the arc portion 16 can make contact with the hanger 32, the electric power tool is suspended from the hanger 32 with the extension direction H of the grip part 3 self-corrected into the horizontal posture or the inclined horizontal posture by the weight balance. This enables a user to attach the electric power tool to the hanger 32 without having to twist the wrist and to detach the electric power tool from the hanger 32 by merely gripping the grip part 3 with little twist of the wrist. As a result, the electric power tool can be attached and detached with ease, which assists in enhancing the ease of use.

In particular, the hanger 32 typically protrudes in the direction orthogonal to the belt 31 or the wall surface. Therefore, the suspension link 14 is hung on the hanger 32 in such a way that the hanger 32 is inserted into the internal space S of the suspension link 14 in the direction orthogonal to both the axial direction F and the extension direction H. Since the internal space S is opened in the insertion direction, the suspension link 14 is hung on the hanger 32 with no twist. This ensures that the extension direction H of the grip part 3 and the axial line E of the body part 2 extend along the side surface of the user's body.

In other words, the extension direction H of the grip part 3 intersecting the body part 2 with the suspension link 14 remains parallel to the side surface of the user's body or the wall surface. This makes it possible to reduce the amount of protrusion of the electric power tool from the side surface of the user's body or the wall surface and makes it hard for the output unit 7 to make contact with the leg of the user 30. Thanks to this feature, the suspended electric power tool does not become an obstacle when the user moves to a job site or performs work preparations such as a task of arranging screws or other fasteners. This assists in avoiding the restraints otherwise imposed on the movement of the user 30 during work preparations.

Since the suspension link 14 is provided with the arc portion 16 and is hung on the hanger 32 in a point-to-point contact relationship, it is possible to rotate the grip part using the suspension link 14 as a pivot point. More specifically, the grip part 3 can be rotated using the arc portion 16 of the suspension link 14 as a pivot point but without having to change the posture of the electric power tool. In other words, the grip part 3 can make rotation about a vertical axis passing through the contact point between the suspension link 14 and the hanger 32 and extending along the vertical direction G and also can make rotation about a horizontal axis passing through the contact point in an orthogonal relationship with the vertical axis. By combining these two kinds of rotation, the portion of the grip part 3 near the battery part 4 can be moved away from the body of the user 30 or the wall surface of a structure having the hanger 32, thereby creating a gap between the body or the wall surface and the grip part 3.

Even if the grip part 3 makes close contact with the body or the wall surface and if there exists no gap for insertion of the thumb when the user attempts to grip the electric power tool, it is possible to rotate the grip part 3 by forcibly inserting the thumb or by holding the grip part 3 with the remaining fingers. Since the rotation of the grip part 3 creates a gap between the body or the wall surface and the grip part 3, it is possible to reliably grip the grip part 3 with the hand of the user 30 and to prevent occurrence of breakage or failure otherwise caused by the drop of the electric power tool. This helps enhance the safety and the ease of use.

The rotation of the suspension link 14 is restrained by the leaf spring 13. Therefore, even if the suspension link 14 makes contact with the hanger 32 or the belt 31 of the user 30 when it is hung on the hanger 32, the suspension link 14 does not rotate from the hanging position to the folded position. This makes it possible to easily perform the hanging of electric power tool without having to hold the suspension link 14 in position, consequently enhancing the ease of use. Since the suspension link 14 has a loop or ring shape and is hung on the hanger 32 in a point-to-point contact relationship, the posture of the electric power tool can be changed with a certain degree of freedom while keeping the tool in a suspended state. This reduces the restraints imposed on the user's moment during work preparations and enables the user to grip the grip part 3 with ease.

The suspension link 14 is made of a rigid material such as a metallic material or a composite material harder than the resin-made housing 1. Thus, the suspension link 14 is hardly deformed by the hanging load, e.g., the weight of the electric power tool, or by the shock generated when the electric power tool is dropped. In the hanging position, therefore, the posture of the suspension link 14 with respect to the electric power is kept constant. This eliminates the need to grip and keep the suspension link 14 in a specified posture when attaching and detaching the suspension link 14 to and from the hanger 32. This makes it easy to perform the attaching and detaching operations. In other words, when the suspension link 14 is removed from the hanger 32 such as a carabiner having a removal-preventing unit, one hand of the user is used in unlocking the removal-preventing unit while the other hand grips the grip part 3 to support the weight of the electric power tool. This prevents occurrence of breakage or deformation otherwise caused by the drop of the electric power tool during attachment and detachment.

The suspension link 14 can be kept in the folded position when the electric power tool performs a screw tightening task or other tasks. Thanks to this feature, the suspension link 14 does not become an obstacle during the course of performing the above task. This means that the ease of use during works is not impaired by the addition of the suspension link 14. In the folded position, the outer diameter of a partial extension of the arc portion 16 becomes greater than the outer diameter of the body part 2. Thus, the arc portion 16 protrudes outwards from the recess by the dimension corresponding to the outer diameter difference L (see FIG. 2), thereby providing a finger engagement portion 20. The suspension link 14 can be easily unfolded from the folded position by holding the finger engagement portion 20 with the finger tips.

There are many right-handed persons, meaning that the grip part 3 is often gripped with the right hand when the tool is in use. In the present embodiment, the recess 10 is formed to lie at the left side of the body part 2 when the tool is in use. Thanks to this feature, the finger engagement portion 20 protrudes toward the left side, i.e., toward the user 30, and seldom makes contact with the wall surfaces at a job site. The suspension link 14 can be easily operated in the hanging position with the left hand left empty without gripping the grip part 3. The suspension link 14 may have a rectangular shape, e.g., a square shape, or an elliptical shape, provided that the internal space S is opened in an orthogonal relationship with the axial direction F and the extension direction H and that the suspension link 14 is capable of hanging the electric power tool along the side surface of the body of the user 30 and the wall surface of the structure having the hanger 32.

While the invention has been shown and described with respect to the embodiments, it will be understood by those skilled in the art that various changes and modification may be made without departing from the scope of the invention as defined in the following claims.

What is claimed is:

1. An electric power tool, comprising:

a body part for outputting a rotational force at one end thereof;

a grip part provided to extend from the body part in an intersecting relationship with the body part; and a suspension link provided at the other end of the body part for hanging the body part, the suspension link having a continuous loop shape, wherein the body part is suspended from the suspension link using the suspension link as a pivot point, and wherein the body part includes two through-holes extending through the body part, the suspension link passing through the through-holes of the body part.

2. The electric power tool of claim 1, wherein the suspension link includes a through-hole orthogonal to both an extension direction of the grip part and an axial direction of the body part when the body part is hung by the suspension link.

3. The electric power tool of claim 1, wherein the suspension link is made of a rigid material.

4. The electric power tool of claim 1, wherein the suspension link includes a through-hole, which is an internal space of the suspension link, and the through-hole of the suspension link is opened in an orthogonal relationship with an extension direction of the grip part and an axial direction of the body part when the body part is hung by the suspension link.

5. An electric power tool, comprising:

a body part for outputting a rotational force at one end thereof;

a grip part provided to extend from the body part in an intersecting relationship with the body part; and a suspension link provided at the other end of the body part for hanging the body part, the suspension link having a continuous loop shape, wherein the body part is suspended from the suspension link using the suspension link as a pivot point, and wherein the body part includes an accommodation portion for accommodating the suspension link, the suspension link being position-changeable between a folded position in which the suspension link is accommodated within the accommodation portion and a hanging position in which the body part is suspended from the suspension link.

6. The electric power tool of claim 1, wherein the suspension link is made of a rigid material and is position-changeable between a folded position in which the suspension link is accommodated within an accommodation portion and a hanging position in which the body part is suspended from the suspension link, the body part including a movement restraint portion for restraining a position-changing movement of the suspension link in the hanging position.

7. The electric power tool of claim 6, wherein the accommodation portion is designed to accommodate the suspension link in a state that the suspension link partially protrudes from the body part, a partially protruding portion of the suspension link serving as a finger engagement portion for a user to take out the suspension link from the accommodation portion.

8. The electric power tool of claim 5, wherein the accommodation portion is designed to accommodate the suspension link in a state that the suspension link partially protrudes from the body part, a partially protruding portion of the suspension link serving as a finger engagement portion for a user to take out the suspension link from the accommodation portion.

9. The electric power tool of claim 5, wherein the body part includes two through-holes extending through the body part, the suspension link passing through the through-holes of the body part, and further comprising an elastic member arranged within the body part for elastically holding the suspension link, the elastic member being designed to make contact with a portion of the suspension link passing through the through-holes of the body part.

10. An electric power tool, comprising:

a body part for outputting a rotational force at one end thereof;

a grip part provided to extend from the body part in an intersecting relationship with the body part; and a suspension link provided at the other end of the body part for hanging the body part, the suspension link having a continuous loop shape, wherein the body part is suspended from the suspension link using the suspension link as a pivot point, wherein the suspension link is made of a rigid material and is position-changeable between a folded position in which the suspension link is accommodated within an accommodation portion and a hanging position in which the body part is suspended from the suspension link, the body part including a movement restraint portion for restraining a position-changing movement of the suspension link in the hanging position, and wherein the body part includes two through-holes extending through the body part, the suspension link passes through the through-holes of the body part, and further comprising an elastic member arranged within the body part for elastically holding the suspension link, the elastic member being designed to make contact with a portion of the suspension link passing through the through-holes of the body part.

* * * * *